US009728084B2

(12) United States Patent
Stenneth

(10) Patent No.: US 9,728,084 B2
(45) Date of Patent: Aug. 8, 2017

(54) METHOD AND APPARATUS FOR PROVIDING VEHICLE CLASSIFICATION BASED ON AUTOMATION LEVEL

(71) Applicant: HERE Global B.V., Veldhoven (NL)

(72) Inventor: Leon Stenneth, Chicago, IL (US)

(73) Assignee: HERE GLOBAL B.V., Veldhoven (NL)

( * ) Notice: Subject to any disclaimer, the term of this patent is extended or adjusted under 35 U.S.C. 154(b) by 87 days.

(21) Appl. No.: 14/631,453

(22) Filed: Feb. 25, 2015

(65) Prior Publication Data

US 2016/0247394 A1 Aug. 25, 2016

(51) Int. Cl.

| | |
|---|---|
| ***G08G 1/01*** | (2006.01) |
| ***G08G 1/015*** | (2006.01) |
| ***G07C 5/00*** | (2006.01) |
| ***G07C 5/08*** | (2006.01) |

(52) U.S. Cl.

CPC ..... *G08G 1/0112* (2013.01); *G07C 5/008* (2013.01); *G07C 5/0808* (2013.01); *G08G 1/015* (2013.01); *G08G 1/0129* (2013.01); *G08G 1/0141* (2013.01)

(58) Field of Classification Search

None

See application file for complete search history.

(56) References Cited

U.S. PATENT DOCUMENTS

2010/0063664 A1* 3/2010 Anderson ..... G05D 1/024 701/23
2014/0085475 A1* 3/2014 Bhanu ..... G06K 9/00825 348/148
2015/0187013 A1* 7/2015 Adams ..... G06Q 30/0283 705/4
2015/0187019 A1* 7/2015 Fernandes ..... G06Q 40/08 705/4
2015/0269444 A1* 9/2015 Lameyre ..... G06K 9/00785 382/104
2015/0308837 A1* 10/2015 Cudak ..... G05D 1/0278 701/23

(Continued)

OTHER PUBLICATIONS

NPL Current European Projects in Cooperative Vehicle-Highway Automation Publication No. FHWA-HRT-12-033 Dec. 2012.*

(Continued)

*Primary Examiner* — Truc M Do

(74) *Attorney, Agent, or Firm* — Ditthavong & Steiner, P.C.

(57) ABSTRACT

An approach is provided for classifying one or more vehicles based on their level of automation. The approach involves determining training sensor data collected during at least one driving operation of one or more vehicles, wherein one or more automation levels of the one or more vehicles are known. The approach also involves determining one or more sensor signatures for the one or more automation levels based, at least in part, on one or more values of one or more classification features extracted from the training sensor data. The approach further involves causing, at least in part, a classification of one or more other vehicles according to the one or more automation levels based, at least in part, on the one or more sensor signatures and sensor data associated with the one or more other vehicles.

20 Claims, 17 Drawing Sheets

(56) References Cited

U.S. PATENT DOCUMENTS

2015/0314780 A1* 11/2015 Stenneth ..... B60W 30/00
701/23

OTHER PUBLICATIONS

Gupte et al., "Detection and Classification of Vehicles", IEEE Transactions on Intelligent Transportation Systems, Mar. 2002, vol. 3, No. 1, pp. 37-47.
West Virginia Department of Transportation, "Motor Vehicle Classifications", retrieved on May 27, 2015, Transportation.WV.gov, 1 Page.
Stenneth et al., "Transportation Mode Detection using Mobile Phones and GIS Information", ACM SIGSPATIAL GIS '11, Nov. 2011, pp. 54-63.

* cited by examiner

FIG. 11A 1101 1103 1105 1107 1109

| Ground truth category | Vehicle status feature | | Driver condition feature | | Environmental feature | | Derived feature | |
|---|---|---|---|---|---|---|---|---|
| | Feature 1 | Feature 2 | Feature 3 | Feature 4 | Feature 5 | Feature 6 | Feature 7 | Feature n |
| Manual driven | 4 | True | 456 | 22 | 99 | False | True | False |
| Partially autonomous | 5 | True | 222 | 456 | 89 | True | False | True |
| Fully autonomous | 7 | False | 4567 | 455 | 67 | False | True | False |
| Manual driven | 8 | False | 642 | 78 | 99 | False | True | False |
| Fully autonomous | 8 | True | 897 | 89 | 67 | False | True | False |
| … | … | … | … | … | … | … | … | … |

FIG. 11B

| Vehicle status feature | | Driver condition feature | | Environmental feature | | Derived feature | |
|---|---|---|---|---|---|---|---|
| Feature 1 | Feature 2 | Feature 3 | Feature 4 | Feature 5 | Feature 6 | Feature 7 | Feature n |
| 4.5 | True | 458 | 28 | 98 | False | True | False |

METHOD AND APPARATUS FOR PROVIDING VEHICLE CLASSIFICATION BASED ON AUTOMATION LEVEL

BACKGROUND

Service providers receive sensor data from different type of vehicles. Such sensor data are important for traffic safety analysis, resource allocation, road infrastructure management, and other applications. However, sensor data may vary in terms of accuracy, reliability, and relevancy. Since sensor data from certain vehicles may be considered to be of higher quality, service providers are continually challenged to deliver value and convenience to consumers by providing automated vehicle classification to enable the provision of more customized services to travelers and vehicles.

SOME EXAMPLE EMBODIMENTS

Therefore, there is a need for an approach for classifying one or more vehicles based on their level of automation.

According to one embodiment, a method comprises determining training sensor data collected during at least one driving operation of one or more vehicles, wherein one or more automation levels of the one or more vehicles are known. The method also comprises determining one or more sensor signatures for the one or more automation levels based, at least in part, on one or more values of one or more classification features extracted from the training sensor data. The method further comprises causing, at least in part, a classification of one or more other vehicles according to the one or more automation levels based, at least in part, on the one or more sensor signatures and sensor data associated with the one or more other vehicles.

According to another embodiment, an apparatus comprises at least one processor, and at least one memory including computer program code for one or more computer programs, the at least one memory and the computer program code configured to, with the at least one processor, cause, at least in part, the apparatus to determine training sensor data collected during at least one driving operation of one or more vehicles, wherein one or more automation levels of the one or more vehicles are known. The apparatus is also caused to determine one or more sensor signatures for the one or more automation levels based, at least in part, on one or more values of one or more classification features extracted from the training sensor data. The apparatus is further caused to cause, at least in part, a classification of one or more other vehicles according to the one or more automation levels based, at least in part, on the one or more sensor signatures and sensor data associated with the one or more other vehicles.

According to another embodiment, a computer-readable storage medium carries one or more sequences of one or more instructions which, when executed by one or more processors, cause, at least in part, an apparatus to determine training sensor data collected during at least one driving operation of one or more vehicles, wherein one or more automation levels of the one or more vehicles are known. The apparatus is also caused to determine one or more sensor signatures for the one or more automation levels based, at least in part, on one or more values of one or more classification features extracted from the training sensor data. The apparatus is further caused to cause, at least in part, a classification of one or more other vehicles according to the one or more automation levels based, at least in part, on the one or more sensor signatures and sensor data associated with the one or more other vehicles.

According to another embodiment, an apparatus comprises means for determining training sensor data collected during at least one driving operation of one or more vehicles, wherein one or more automation levels of the one or more vehicles are known. The apparatus also comprises means for determining one or more sensor signatures for the one or more automation levels based, at least in part, on one or more values of one or more classification features extracted from the training sensor data. The apparatus further comprises means for causing, at least in part, a classification of one or more other vehicles according to the one or more automation levels based, at least in part, on the one or more sensor signatures and sensor data associated with the one or more other vehicles.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of originally filed claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings:

FIG. 11A is a diagram that represents a training model to classify one or more vehicles, according to one example embodiment;

FIG. 11B is a diagram wherein features for at least one new vehicle (i.e., vehicle not already used for the training data) are extracted for determine their level of automation, according to one example embodiment;

DESCRIPTION OF SOME EMBODIMENTS

Examples of a method, apparatus, and computer program for classifying one or more vehicles based on their level of automation are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention.

As used herein, the term automation levels refer to a manually driven vehicle, a partially autonomous vehicle, a fully autonomous vehicle, or a combination thereof. Although various embodiments are described with respect to automation levels, it is contemplated that the approach described herein may be used with other vehicle types.

Figure 1:
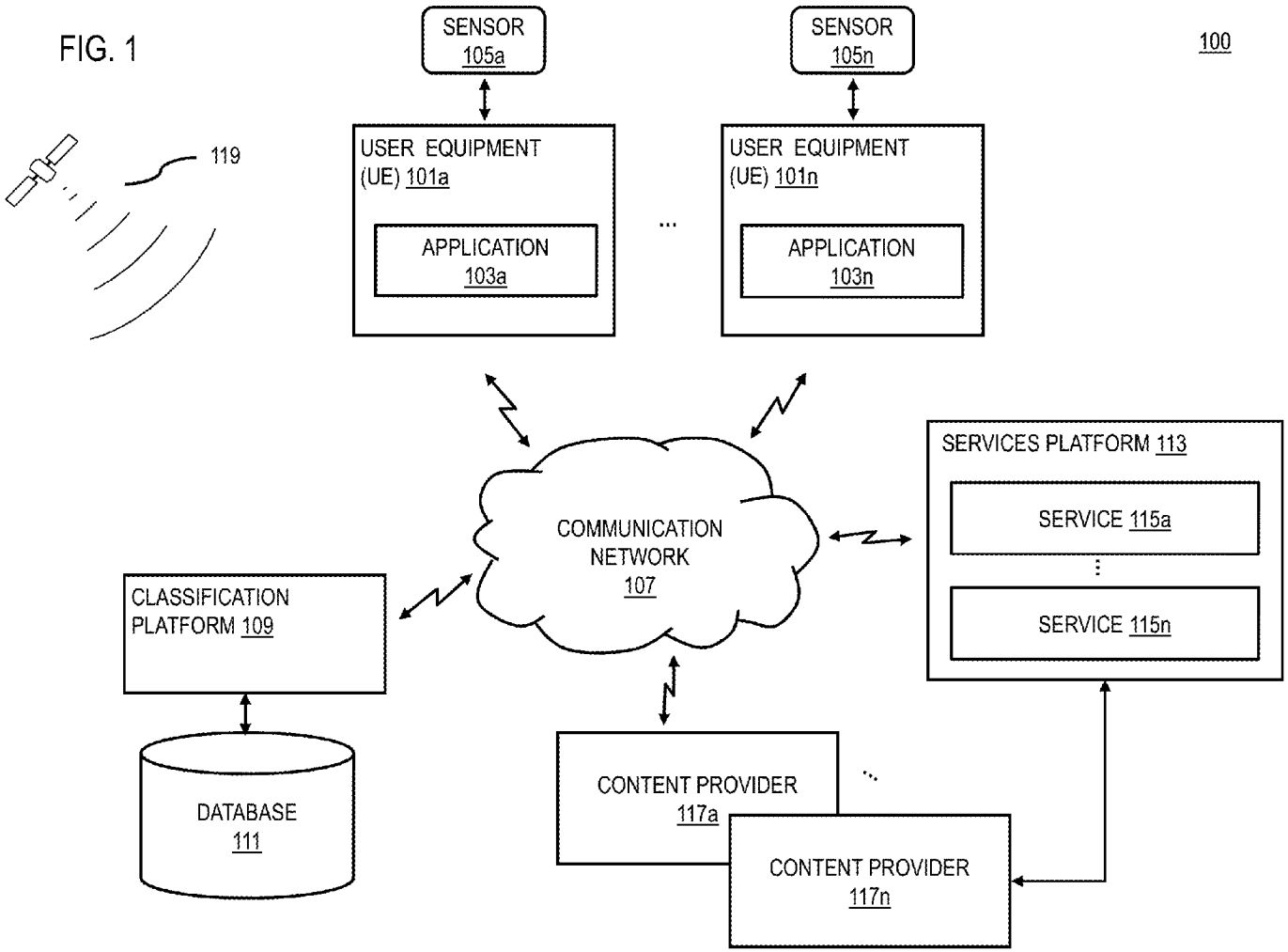
FIG. 1 is a diagram of a system capable of classifying one or more vehicles based on their level of automation, according to one embodiment.

FIG. 1 is a diagram of a system capable of classifying one or more vehicles based on their level of automation, according to one embodiment. In one scenario, there are several categories of vehicles on the road. These categories may include but is not limited to a manually driven vehicle, a partially self-driving vehicle, a fully self-driving vehicle, etc. There is a need for an automated system to identify the category of these vehicles for providing different level of services. For example, service providers may assign different quality scores for probe data received from one or more vehicles based on their level of automation. In one scenario, different vehicles have different sampling rates for probe data, for example, some vehicle may sample probe data via GPS sensors every 5 seconds whilst other vehicles may sample every 2 minutes. As a result, there should be a system to weigh the quality of incoming probe data from different vehicles based on their level of automation.

To address this problem, a system 100 of FIG. 1 introduces the capability to automatically classify a moving vehicle in terms of its level of automation. In one scenario, one or more vehicles provide sensor information (e.g., vehicle status information, driver condition information, environmental information) to system 100. Then, based on the observed patterns in the sensor traces the system 100 constructs a training set for recognizing different vehicle categories. The system 100 decides if the vehicle is a manually driven vehicle, a partially autonomous vehicle, or a fully autonomous vehicle. In one embodiment, the system 100 may automatically classify vehicles using machine learning to one of the three levels of automation. In one scenario, system 100 may attach weight to differentiate the quality of probe data received from vehicles with different level of automation. Such automated determination of vehicle category may result in automatic selection of weights for the incoming probe data. In another scenario, determination of automation level for one or more vehicles may result in customized advertisements. The type of advertisements sent to a manually driven vehicle should not be sent to a fully automated vehicle. For example, a manually driven vehicle may be sent advertisements for gas coupons on the UE 101 associated with the vehicle or the driver of the vehicle. Then, the driver can use those coupons while purchasing gas. On the other hand, if the vehicle is fully autonomous then certain advertisements become unnecessary since a driver may not be on board, and the vehicle can be driving on its own. In a further scenario, the classification platform 109 may prevent driver distractions in a moving vehicle. In one example embodiment, the classification platform 109 may allow certain services (e.g., music) on a mobile device or a mapping service based on a determination that a driver is maneuvering a vehicle. In another example embodiment, the classification platform 109 may cause a presentation of media that is not distracting to the driver during heavy traffic flow, and allow visual media if the traffic is light and less distracting (e.g., cause a presentation of coupons based on eye movements of the driver). In another scenario, manually driven vehicles may have to follow different rules and regulations than a fully automated vehicle (e.g., manually driven vehicles may have different speed limits as compared to a fully autonomous vehicle). Hence, automatic determination of vehicle categories may assist in ascertaining whether a vehicle was abiding by the rules and regulation (e.g., police officer may point their speed guns at the vehicle to determine the vehicle category and its speed).

As shown in FIG. 1, the system 100 comprises user equipment (UE) 101*a*-101*n* (collectively referred to as UE 101) that may include or be associated with applications 103*a*-103*n* (collectively referred to as applications 103) and sensors 105*a*-105*n* (collectively referred to as sensors 105). In one embodiment, the UE 101 has connectivity to a classification platform 109 via the communication network 107. In one embodiment, the classification platform 109 performs one or more functions associated with classifying one or more vehicles based on their level of automation.

By way of example, the UE 101 is any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, fitness device, television receiver, radio broadcast receiver, electronic book device, game device, or any combination thereof, including the accessories and peripherals of these devices, or any combination thereof. It is also contemplated that the UE 101 can support any type of interface to the user (such as "wearable" circuitry, etc.). In one embodiment, the UE 101 may be a vehicle (e.g., cars), a mobile device (e.g., phone), and/or a combination of the two.

By way of example, the applications 103 may be any type of application that is executable at the UE 101, such as, location-based service applications, content provisioning services, camera/imaging application, mapping application, navigation applications, media player applications, social networking applications, calendar applications, and the like. In one embodiment, one of the applications 103 at the UE 101 may act as a client for the classification platform 109 and perform one or more functions associated with the functions of the classification platform 109 by interacting with the classification platform 109 over the communication network 107. In one scenario, the applications 103 may interface with the sensors 105 and/or the services platform 113 via the communication network 107 for classifying one or more vehicles based on their level of automation.

By way of example, the sensors 105 may be any type of sensor. In certain embodiments, the sensors 105 may include, for example, a global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data (e.g., the camera sensors may automatically capture emotions of drivers or eye movements, or environment inside or outside the vehicle), an audio recorder for gathering audio data, velocity sensors mounted on steering wheels of the vehicles, and the like. In one embodiment, the sensors 105 may include steering wheel sensor, a driver seat pressure sensor, a brake pressure sensor, a heat sensor, a motion sensor, a laser sensor, a telematics sensor, or a combination thereof. In another embodiment, the sensors 105 may include light sensors, oriental sensors augmented with height sensor and acceleration sensor (e.g., an accelerometer can measure acceleration and can be used to determine orientation of the vehicle), tilt sensors to detect the degree of incline or decline of the vehicle along a path of travel, moisture sensors, pressure sensors, etc. In a further example embodiment, sensors about the perimeter of the vehicle may detect the relative distance of the vehicle from lane or roadways, the presence of other vehicles, pedestrians, traffic lights, potholes and any other objects, or a combination thereof. In one scenario, the sensors 105 may detect weather data, traffic information, or a combination thereof. In one example embodiment, the UE 101 may include GPS receivers to obtain geographic coordinates from satellites 119 for determining current location, speed information and time associated with the UE 101 and/or a vehicle. Further, the location can be determined by a triangulation system such as A-GPS, Cell of Origin, or other location extrapolation technologies. In another embodiment, the sensors 105 may include D-GPS, windshield wiping sensors, microphone sensors, shift sensor, pedal sensor, lever sensor, speed sensor, headlamp sensor, steering wheel sensor, or a combination thereof. These sensors provide mobility information about the vehicle, environmental conditions, and driver status information.

The communication network 107 of system 100 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

In one embodiment, the classification platform 109 may be a platform with multiple interconnected components. The classification platform 109 may include multiple servers, intelligent networking devices, computing devices, components and corresponding software for classifying one or more vehicles based on their level of automation. In addition, it is noted that the classification platform 109 may be a separate entity of the system 100, a part of the one or more services 115*a*-115*n* (collectively referred to as services 115) of the services platform 113, or included within the UE 101 (e.g., as part of the applications 103).

In one embodiment, the classification platform 109 may automatically determine the level of automation for the one or more vehicles. In one scenario, the classification platform 109 may process sensor data received from one or more vehicles to determine vehicle status information, driver condition information, environmental information, or a combination thereof. Then, the one or more vehicles are classified into a manually driven vehicle, a partially autonomous vehicle, a fully autonomous vehicle, or a combination thereof. Subsequently, the classification platform 109 may determine the level of automation for at least one new vehicle based on extraction and pattern recognition of the classification features (i.e., vehicle status information, driver condition information, environmental information, or a combination thereof). In one embodiment, the classification platform 109 may attach quality scores to the incoming sensor data based, at least in part, on accuracy level, reliability level, relevancy level, or a combination thereof. In one scenario, GPS sensors from a fully automated vehicle may be more accurate than the GPS sensor of a manually driven vehicle. As a result, the classification platform 109 may attach higher accuracy scores to the sensor data received from GPS sensors of an automated vehicle than the sensor data received from GPS sensors of a manually driven vehicle.

In one embodiment, the database 111 may store velocity information for one or more vehicles (e.g., manually driven vehicles, partially automated vehicles, fully automated vehicles). In another embodiment, the database 111 may store classification features (e.g., vehicle status feature, a driver condition feature, an environmental feature, derived feature) for one or more vehicles. In a further scenario, the database 111 may store accuracy information, the reliability information, the relevancy information, or a combination thereof for one or more sensors. The information may be any multiple types of information that can provide means for aiding in the content provisioning and sharing process.

The services platform 113 may include any type of service. By way of example, the services platform 113 may include location based services, navigation services, notification services, social networking services, content (e.g., audio, video, images, etc.) provisioning services, application services, storage services, contextual information determination services, information (e.g., weather, news, etc.) based services, etc. In one embodiment, the services platform 113 may interact with the UE 101, the classification platform 109 and the content provider 117 to supplement or aid in the processing of the content information.

By way of example, the services 115 may be an online service that reflects interests and/or activities of users. In one scenario, the services 115 may provide information on the status of a user (e.g., physical behavior of at least one user at varying granularity at a specific time period) of at least one vehicle, and a variety of additional information. The services 115 allow users to share location information, activities information (e.g., speed information), contextual information, historical user information and interests within their individual networks, and provides for data portability. The services 115 may additionally assist in providing the classification platform 109 with information on travel plans, user profile information, etc.

The content providers 117*a*-117*n* (collectively referred to as content provider 117) may provide content to the UE 101, the classification platform 109, and the services 115 of the services platform 113. The content provided may be any type of content, such as textual content, audio content, video content, image content, etc. In one embodiment, the content provider 117 may provide content that may supplement content of the applications 103, the sensors 105, or a combination thereof. By way of example, the content provider 117 may provide content that may aid in the classification of one or more vehicles based on their level of automation. In one embodiment, the content provider 117 may also store content associated with the UE 101, the classification platform 109, and the services 115 of the services platform 113. In another embodiment, the content provider 117 may manage access to a central repository of data, and offer a consistent, standard interface to data, such as a repository of classification features and/or automation levels for one or more vehicles. Any known or still developing methods, techniques or processes for retrieving and/or accessing features for road links from one or more sources may be employed by the classification platform 109.

By way of example, the UE 101, the classification platform 109, the services platform 113, and the content provider 117 communicate with each other and other components of the communication network 107 using well known, new or still developing protocols. In this context, a protocol includes a set of rules defining how the network nodes within the communication network 107 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 2:
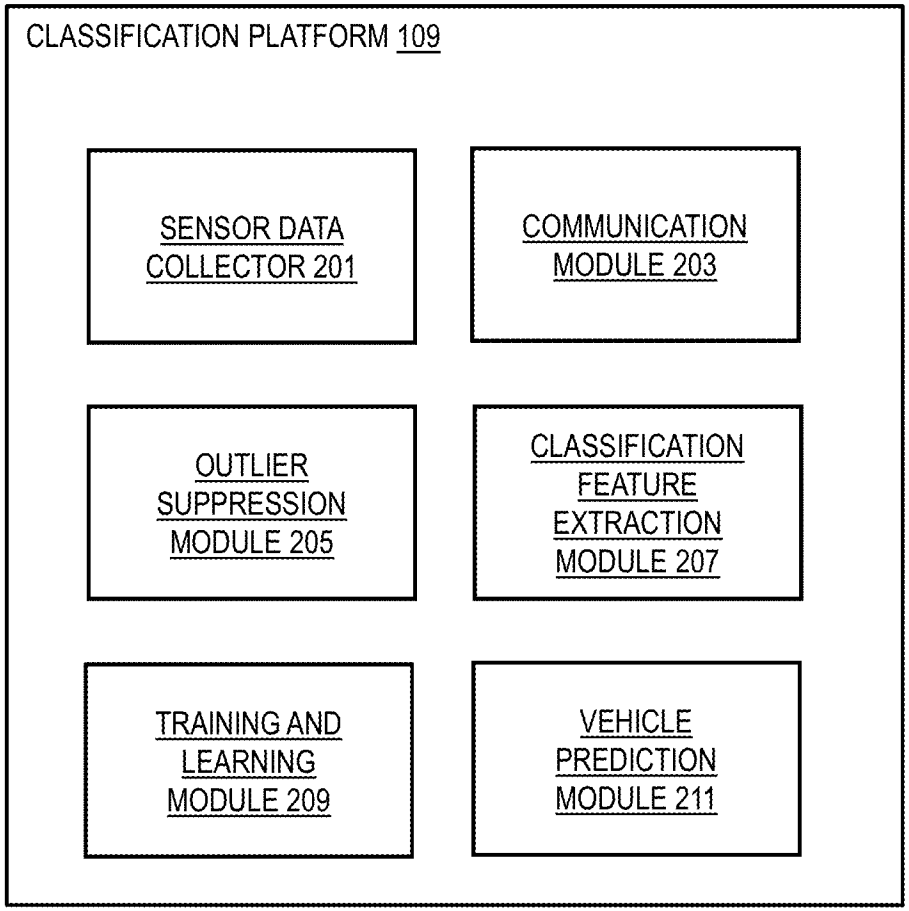
FIG. 2 is a diagram of the components of the classification platform 109, according to one embodiment.

FIG. 2 is a diagram of the components of a classification platform 109, according to one embodiment. By way of example, the classification platform 109 includes one or more components for classifying one or more vehicles based on their level of automation. It is contemplated that the functions of these components may be combined in one or more components or performed by other components of equivalent functionality. In one embodiment, the classification platform 109 includes a sensor data collector 201, a communication module 203, an outlier suppression module 205, a classification feature extraction module 207, a training and learning module 209, and a vehicle prediction module 211.

In one embodiment, the sensor data collector 201 may collect sensor data from one or more sensors associated with at least one vehicle, at least one user, or a combination thereof. In one scenario, each vehicle has a set of sensors, and sensor information is generated as the vehicle moves. In one example embodiment, one or more sensors of at least one autonomous vehicle may collect three levels of sensor information in real-time, for example, status of the vehicle, the environment around the vehicle, the status of the driver, or a combination thereof. Once the sensor data is collected, the sensor data is transmitted over to the classification platform 109 via the communication module 203.

In one embodiment, the communication module 203 may control the communication of collected sensor information from the vehicle to the classification platform 109. In one scenario, the communication module 203 may take sensor data from the sensor data collector 201 and sends it to the classification platform 109. In another scenario, the communication module 203 may support different communication protocols which includes but is not limited to Wi-Fi, dedicated short range communications (DSRC), vehicle to infrastructure communications, WiMAX, V2I communication, other near filed communication systems, etc. In another embodiment, the communication module 203 may control sending of sensor data from the classification platform 109 to the vehicle. Subsequently, once the sensor data is successfully transmitted to the classification platform 109, the outlier suppression module 205 may process and analyze the data to determine the accuracy and reliability of the sensor data.

In one embodiment, the outlier suppression module 205 may suppress inaccurate and unreliable sensor information that is received from the communication module 203. In one scenario, not all sensor information submitted by the vehicle is useful. The usefulness of the data is determined the outlier suppression module 205. In one example embodiment, a typical GPS may be error prone because its reading is several meters from the actual location. The outlier suppression module 205 may suppress sensors data received from the error prone GPS. In one scenario, the outlier suppression module 205 may analyze incoming sensor data from individual vehicles, and sensor data that is skewed from the mean or the average may be suppressed. In one example embodiment, the outlier suppression module 205 may suppress unrealistic reported speeds (e.g., speed beyond 200 KPH. In another embodiment, the outlier suppression module 205 may have the capability to run in the central server (i.e., the classification platform 109) and in some implementation it can be running in the vehicles. In one example embodiment, the outlier suppression module 205 may be located on the classification platform 109 or on the vehicles. In one scenario, basic outlier suppression may be done on the vehicle instead of on the central server. In one scenario, instead of sending erroneous and irrelevant sensor data over the air to the classification platform 109, the outlier suppression module 205 in the vehicle may throw erroneous and irrelevant sensor data from the vehicles before the sensor data is sent to the classification platform 109.

In one embodiment, the classification feature extraction module 207 may extract relevant features or patterns for each type of vehicle (i.e. manual, partially autonomous, and fully autonomous) from the sensor data. In one scenario, machine learning and pattern recognition, a feature is an individual measurable heuristic property of a phenomenon being observed. In another scenario, choosing, discriminating and independent classification features are essential for any pattern recognition algorithm being successful in classification. In another embodiment, the feature may be categorized based on vehicle status, driver condition, environment, or a combination thereof. In one scenario, features based on vehicle status may be extracted from the sensors associated with one or more vehicles in real-time, for example, sensors that provide speed information, sensors that provide information on the distance between the leading vehicle and the trailing vehicle, sensors that provide information on the position of the vehicle within the lane, etc. In another scenario, features based on driver condition may be extracted from the sensors that measure the condition of the driver, for example, the physical behavior of the driver. These sensors assist in classification by giving information on the status of the driver and not about the status of the vehicle. In a further scenario, features based on environment may be extracted from the sensors that provide information on the status of the road networks, the internal and external temperatures of the vehicles, and so on. In a further embodiment, these three feature categories may be combined.

In one embodiment, the training and learning module 209 may construct a training set using ground truth data (e.g., historical data) and the feature categories (e.g., vehicle status, driver condition, environment, etc.). In another embodiment, the training set is utilized for teaching the classification platform 109 to recognize different vehicle categories (e.g., manual, partially autonomous, fully autonomous, etc.) automatically using the feature categories.

In one embodiment, the vehicle prediction module 211 may classify at least one new vehicle into at least one vehicle category based, at least in part, on the incoming feature categories information of the at least one vehicle. In one scenario, the classification platform 109 may automatically classify the vehicle as a manually driven vehicle, a partially autonomous vehicle, or a fully autonomous vehicle, based, at least in part, on the incoming data about the vehicle status, driver condition, environment, and a combination thereof.

The above presented modules and components of the classification platform 109 can be implemented in hardware, firmware, software, or a combination thereof. Though depicted as a separate entity in FIG. 1, it is contemplated that the classification platform 109 may be implemented for direct operation by respective UE 101. As such, the classification platform 109 may generate direct signal inputs by way of the operating system of the UE 101 for interacting with the applications 103. In another embodiment, one or more of the modules 201-211 may be implemented for operation by respective UEs, the classification platform 109, or combination thereof. Still further, the classification platform 109 may be integrated for direct operation with services 115, such as in the form of a widget or applet, in accordance with an information and/or subscriber sharing arrangement. The various executions presented herein contemplate any and all arrangements and models.

Figure 3:
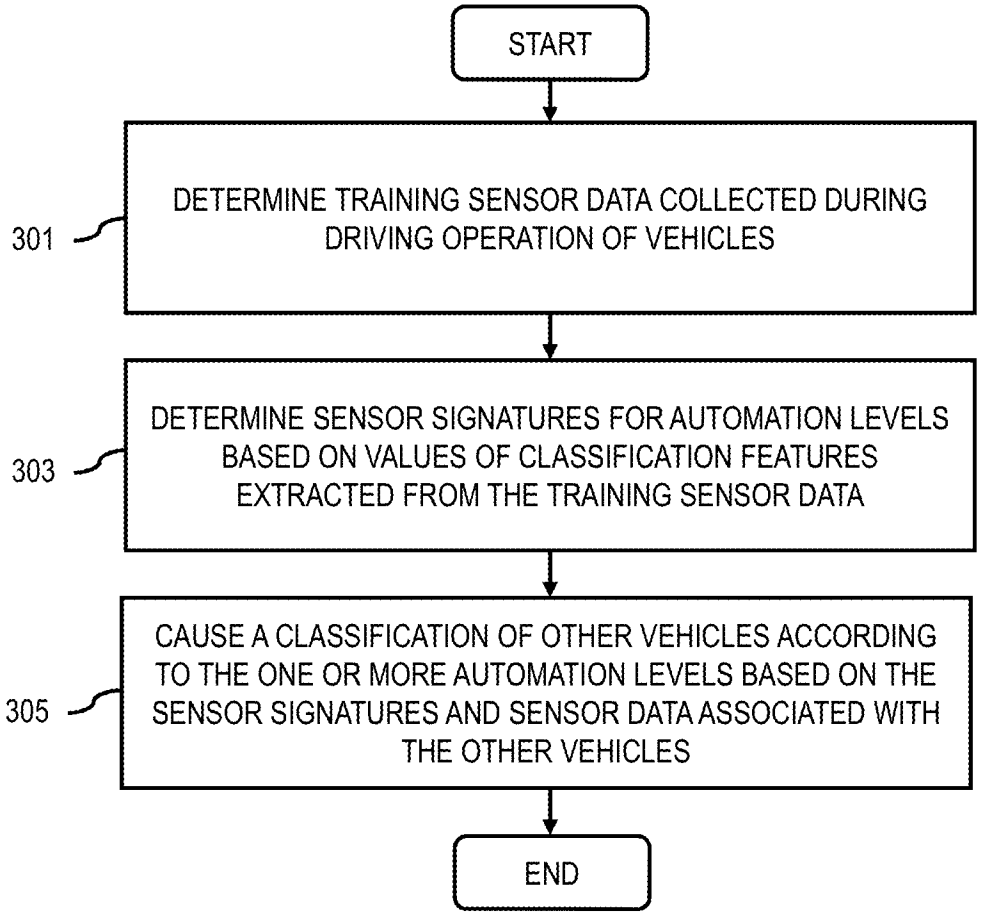
FIG. 3 is a flowchart of a process for determining training sensor data to classify vehicles based on automation levels, according to one embodiment.
Figure 15:
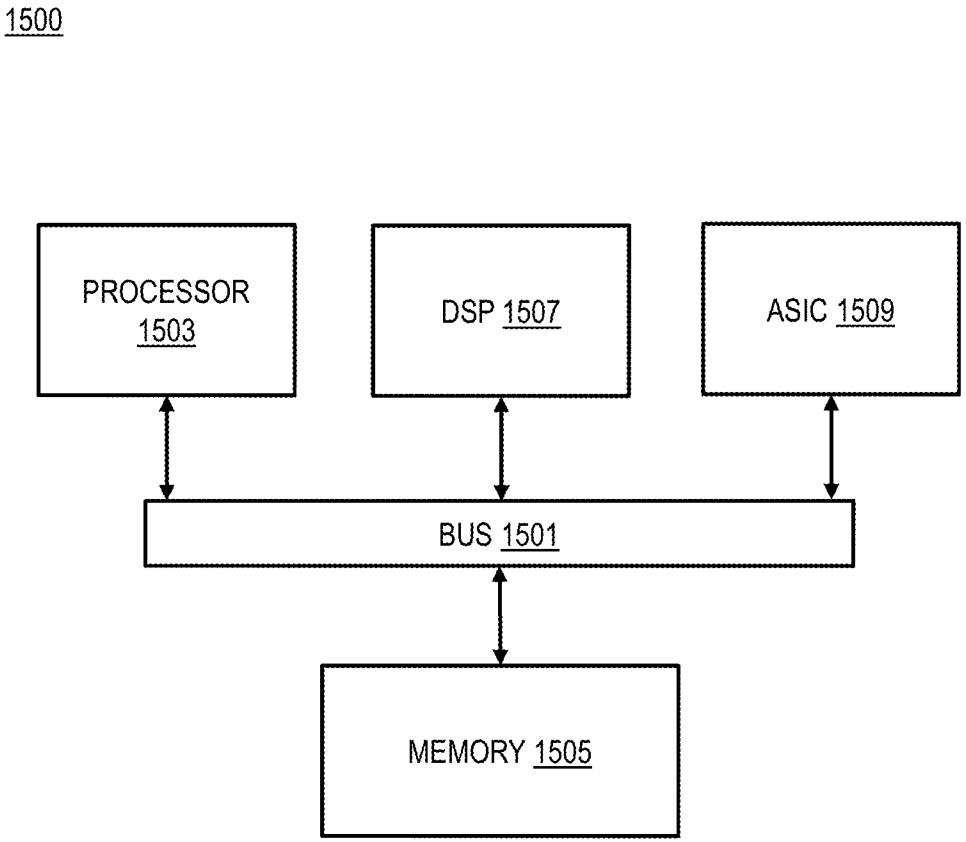
FIG. 15 is a diagram of a chip set that can be used to implement an embodiment of the invention.

FIG. 3 is a flowchart of a process for determining training sensor data to classify vehicles based on automation levels, according to one embodiment. In one embodiment, the classification platform 109 performs the process 300 and is implemented in, for instance, a chip set including a processor and a memory as shown in FIG. 15.

In step 301, the classification platform 109 may determine training sensor data collected during at least one driving operation of one or more vehicles, wherein one or more automation levels of the one or more vehicles are known. In one embodiment, the one or more automation levels include, at least in part, a manually driving vehicle, a partially autonomous vehicle, a fully autonomous vehicle, or a combination thereof. In one scenario, the classification platform 109 may automatically classify (i.e., using machine learning) a moving vehicle as belonging to one of the three categories (i.e., manually driven vehicles, partially autonomous vehicles, and fully autonomous vehicles) based on their level of automation.

In step 303, the classification platform 109 may determine one or more sensor signatures for the one or more automation levels based, at least in part, on one or more values of one or more classification features extracted from the training sensor data. In one embodiment, the one or more classification features include, at least in part, one or more vehicle status features, one or more driver condition features, one or more environmental features, or a combination thereof. In another embodiment, the one or more vehicle status features include, at least in part, a relative position of at least one vehicle within at least one lane, a distance between at least one leading vehicle and at least one trailing vehicle relative to at least one target vehicle, an acceleration information for at least one vehicle, or a combination thereof. In one scenario, the sensors 105 may detect relative distance of at least one vehicle from the one or more passing vehicles. Then, the classification platform 109 may determine that a fully automated vehicle may maintain certain distance from the passing vehicles as compared to a manually driven vehicle. In another scenario, the sensors 105 (e.g., D-GPS, camera sensors, etc.) may detect position of at least one vehicle within a driving lane. Then, the classification platform 109 may determine driving patterns (e.g., standpoint) for an automated vehicle, wherein an automated vehicle positions itself precisely within the lane. On the other hand, the classification platform 109 may determine that driving patterns for a manually driven vehicle is not as accurate (e.g., the vehicle crosses lane lines). In a further embodiment, the one or more environmental features include, at least in part, road network information, traffic information, vehicle internal temperature information, external temperature information, weather information, or a combination thereof. In one scenario, road network information includes one or more traffic signs (e.g., stop sign locations). In another scenario, traffic information includes real time traffic and incident information relative to the driver's location.

In step 305, the classification platform 109 may cause, at least in part, a classification of one or more other vehicles according to the one or more automation levels based, at least in part, on the one or more sensor signatures and sensor data associated with the one or more other vehicles. In one scenario, the classification platform 109 may collect and/or process sensor data received from one or more vehicles during a driving operation to determine classification features (i.e., vehicle status features and/or driver condition features and/or environmental features). Then, the classification platform 109 may determine training sensor data (i.e., sensor signatures for the one or more automation levels). Subsequently, the classification platform 109 may extract similar classification features from the at least one other vehicle to determine the automation level of the at least one other vehicle.

Figure 4:
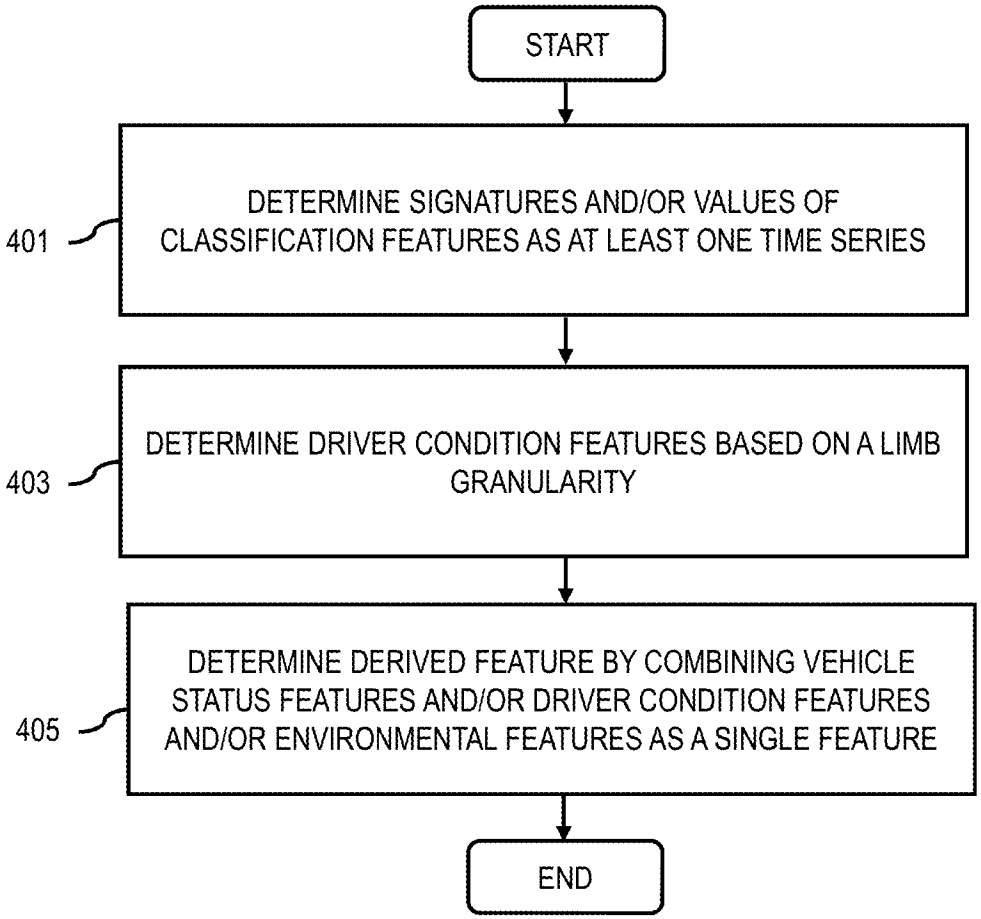
FIG. 4 is a flowchart of a process for determining signatures and/or values of the classification features as at least one time series, driver conditions, and derived features, according to one embodiment.

FIG. 4 is a flowchart of a process for determining signatures and/or values of the classification features as at least one time series, driver conditions, and derived features, according to one embodiment. In one embodiment, the classification platform 109 performs the process 400 and is implemented in, for instance, a chip set including a processor and a memory as shown in FIG. 15.

In step 401, the classification platform 109 may determine the one or more signatures, the one or more values of the one or more classification features, or a combination thereof as at least one time series. In one scenario, the classification platform 109 may measure a sequence of sensor data at successive points in time spaced at uniform time intervals to determine signatures and/or values associated with one or more classification features. In one scenario, time series data are sequences of time stamped records occurring in one or more continuous streams, representing some type of activity. For example, the classification platform 109 may determine that a manually driven vehicle have certain driving patterns (e.g., driver pushing the brakes well ahead of the stop sign) that is different from a fully automated vehicle. In another example embodiment, the classification platform 109 may determine physical behavior (e.g., limb granularity and/or sense granularity) for a user at varying granularity at a specific time period for a manually driven vehicle.

In step 403, the classification platform 109 may determine the one or more driver condition features based, at least in part, on a limb granularity. In one embodiment, the limb granularity categorizes the one or more driver condition features based, at least in part, one or more features associated with a vehicle operation by foot, a vehicle operation by hand, a vehicle operation by speech, or a combination thereof. In another embodiment, the one or more features associated with the vehicle operation by foot includes, at least in part, a sensed position and frequency of function of a foot on a brake pedal, a sensed position and frequency of function of a foot on a gas pedal, or a combination thereof. In one scenario, the sensors 105 (e.g., telematics sensors) may trigger driver condition features wherein physical behavior of a driver is captured. The physical behavior may be modeled at varying granularity of time, for example, the sensed position and/or frequency functions of the right foot on the brake or on the gas pedal may be determined at varying granularity of time. In a further embodiment, the one or more features associated with the vehicle operation by hand includes, at least in part, a steering wheel angle, a wiper operation, a blinker operation, a gear shift operation, or a combination thereof. In another embodiment, the one or more features associated with the vehicle operation by speech includes a use of one or more voice instructions. In one scenario, the sensors 105 (e.g., a microphone) may capture voice instructions given to at least one vehicle by the target driver.

In step 405, the classification platform 109 may determine at least one derived feature by combining the one or more vehicle status features, the one or more driver condition features, the one or more environmental features, or a combination thereof as a single feature. In one embodiment, the one or more classification features include, at least in part, the at least one derived feature. In one scenario, the classification platform 109 may combine vehicle status information and driver condition with the road network information. In another scenario, the classification platform 109 may combine vehicle status features and environmental features with the physical behavior of the driver.

Figure 5:
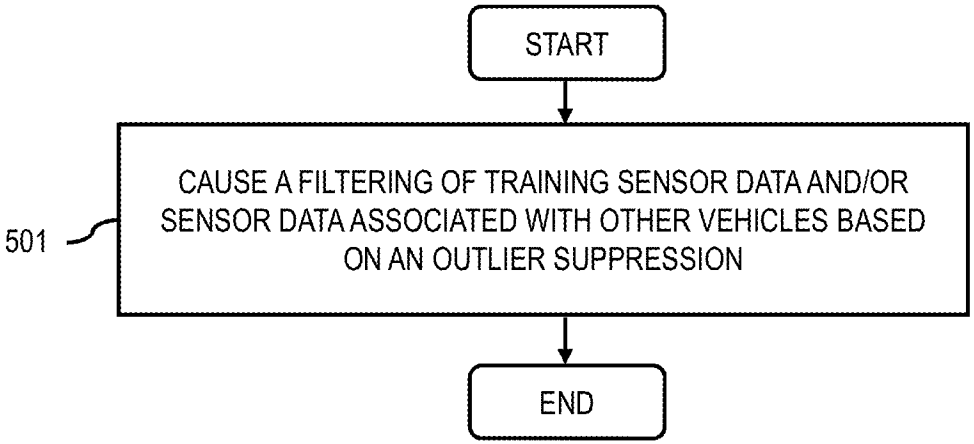
FIG. 5 is a flowchart of a process for filtering the training sensor data, according to one embodiment.

FIG. 5 is a flowchart of a process for filtering the training sensor data, according to one embodiment. In one embodiment, the classification platform 109 performs the process 500 and is implemented in, for instance, a chip set including a processor and a memory as shown in FIG. 15.

In step 501, the classification platform 109 may cause, at least in part, a filtering of the training sensor data, the sensor data associated with the one or more other vehicles based, at least in part, on an outlier suppression. In one scenario, the classification platform 109 may process sensor data to determine accuracy information, reliability information, relevancy information, or a combination thereof. Then, the classification platform 109 may suppress inaccurate sensor data, unreliable sensor data, irrelevant sensor data, or a combination thereof. Subsequently, the classification platform 109 may extract accurate, relevant or reliable features for each type of vehicle from the sensor data.

Figure 6:
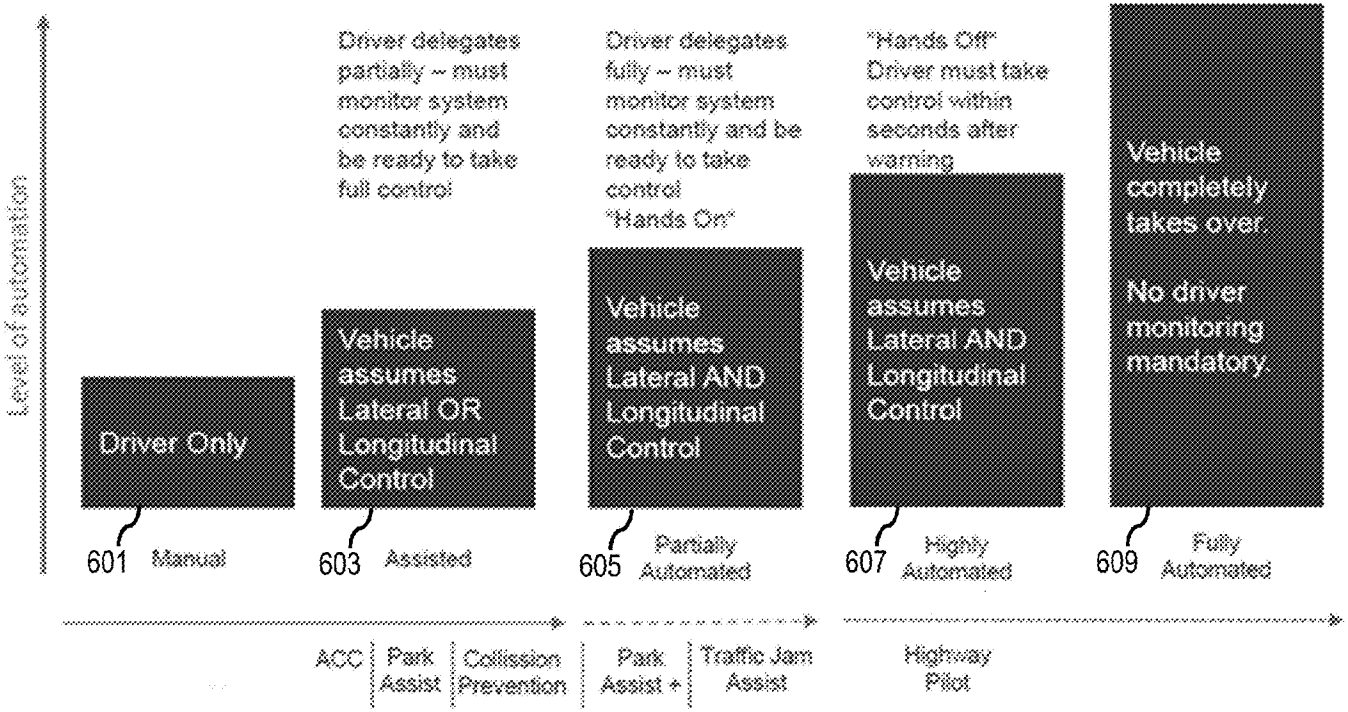
FIG. 6 is a diagram that represents different levels of vehicle automation, according to one example embodiment.

FIG. 6 is a diagram that represents different levels of vehicle automation, according to one example embodiment. In one scenario, block 601 represents manual vehicles without automation functionality. The drivers of the manual vehicles have to maneuver the steering wheel, press the brakes, change the gears, honk the horns, etc. In another scenario, block 603 represents assisted vehicles wherein drivers are not required to perform all manual tasks. For example, the driver may partially delegate the driving control to the vehicle whereupon the vehicle takes over for certain duration of the drive. However, the driver must constantly monitor and should be ready to take full control of the vehicle. In a further scenario, block 605 represents partially automated vehicles wherein a driver fully delegates the driving control to the vehicle (e.g., adaptive cruise control where the car is controlling itself, and the driver is providing little or no input). However, the driver must constantly monitor and should be ready to take hands-on control of the vehicle. For example, the vehicle might encounter complex intersection with multiple pedestrians, so the driver needs to take control of the vehicle. In another scenario, block 607 represents highly automated vehicle wherein a driver fully delegates the driving control to the vehicle, however the driver must take control within few seconds after warning. In another scenario, block 609 represents fully automated vehicle wherein the vehicle completely takes control. For example, the driver need not give any input to the control devices associated with the vehicle since the vehicle are equipped with multiple advanced sensors (e.g., LIDAR sensors, ultrasonic sensors, etc.).

Figure 7:
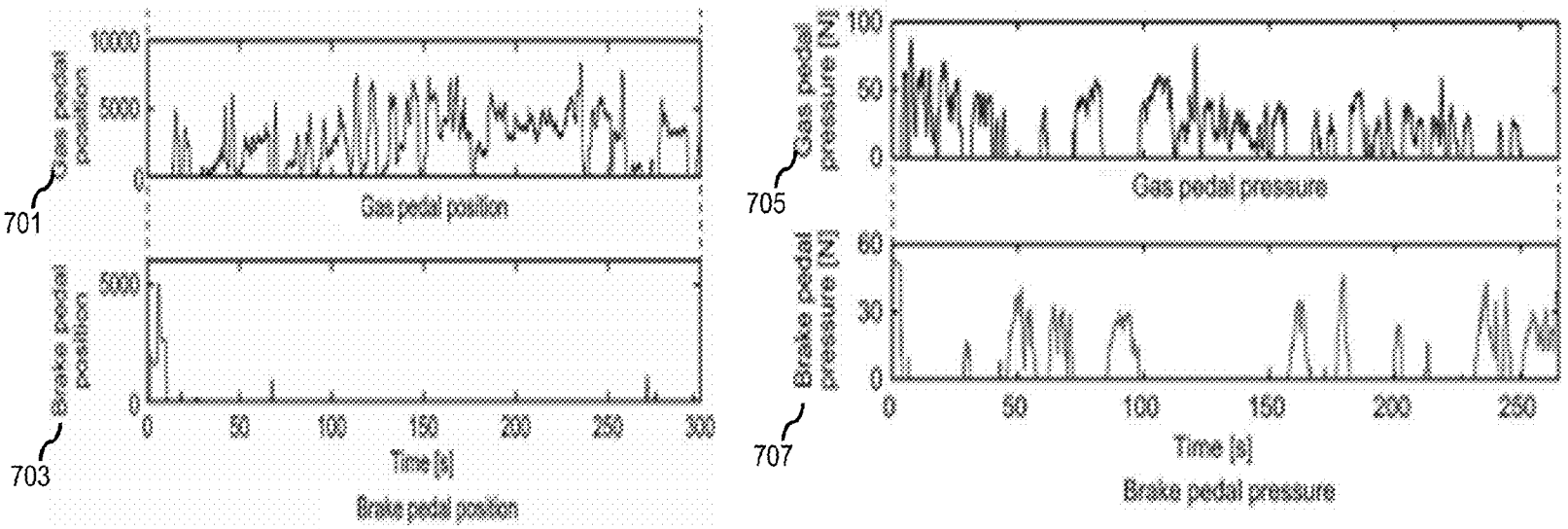
FIG. 7 is a graphical diagram that represents sensor readings as a time series from two different vehicles, according to one example embodiment.

FIG. 7 is a graphical diagram that represents sensor readings as a time series from two different vehicles, according to one example embodiment. In one embodiment, different sensor data are collected from various sensors associated with one or more vehicles and may be plotted on a graph. In one scenario, sensor data on gas pedal pressure 701 and 705 may be collected via pedal sensor. In another scenario, sensor data on brake pedal pressure 703 and 707 may be collected via brake pressure sensors. Since different categories of vehicle produces different sensor signature, the frequency of polling these sensors for data readings may vary for power consumption reasons or for processing/bandwidth reasons. In one scenario, the classification platform 109 may observe sensor data obtained through repeated analysis over time. Such time series observation may be used to determine the mean value or the average value for gas pedal pressure and/or brake pedal pressure to determine the level of automation for at least one vehicle.

Figure 8:
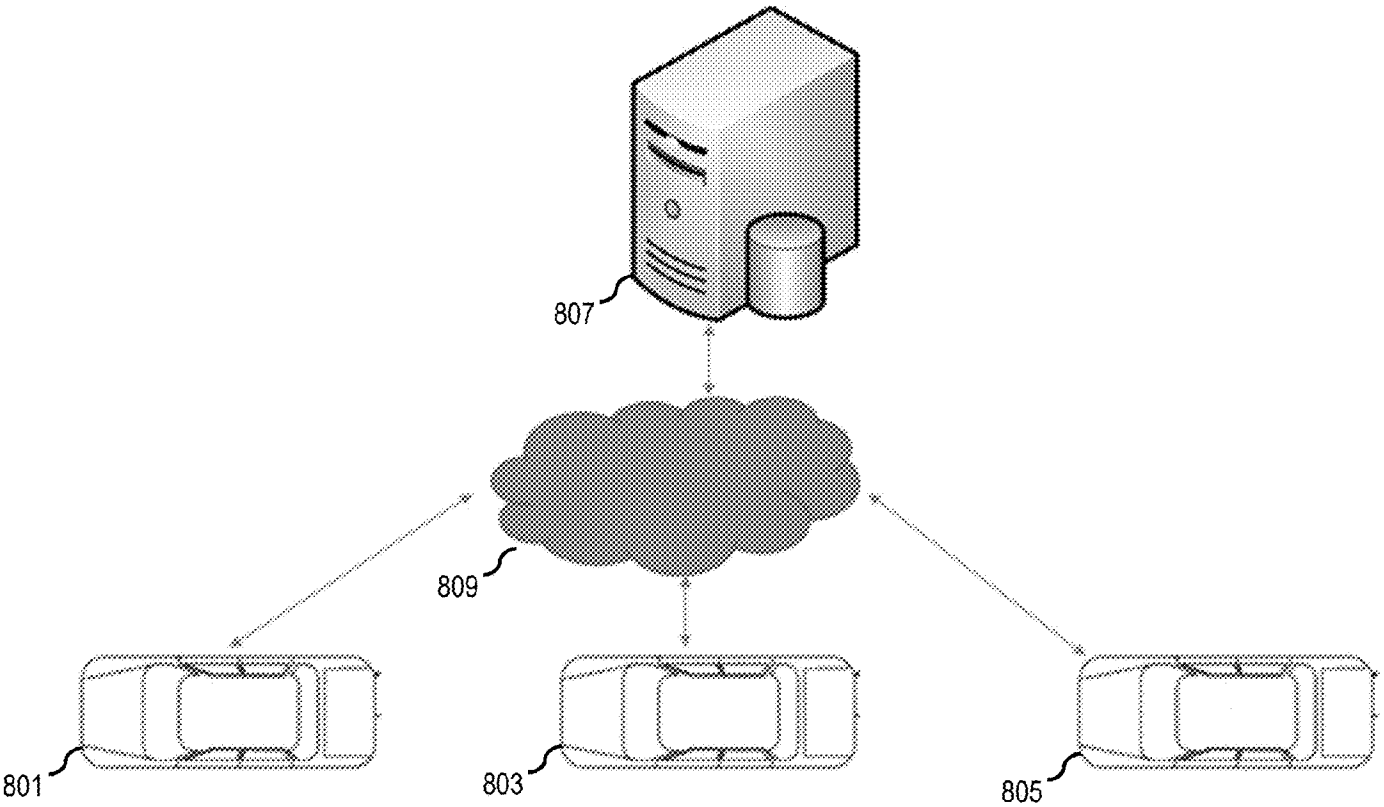
FIG. 8 is a diagram that represents the functionality of the communication module 203, according to one example embodiment.

FIG. 8 is a diagram that represents the functionality of the communication module 203, according to one example embodiment. In one embodiment, the communication module 203 may be on the vehicles 801, 803 and 805. The communication module 203 may receive sensor data from the vehicles 801, 803 and 805. Then, the communication module 203 may transmit the sensor data to the central server 807 (i.e., classification platform 109) via communication network 809. Similarly, the central server 807 may also send information to the vehicles 801, 803 and 805. In summary, the communication module 203 sends the sensor data from the vehicles over the channel to the server, and vice versa.

Figure 9:
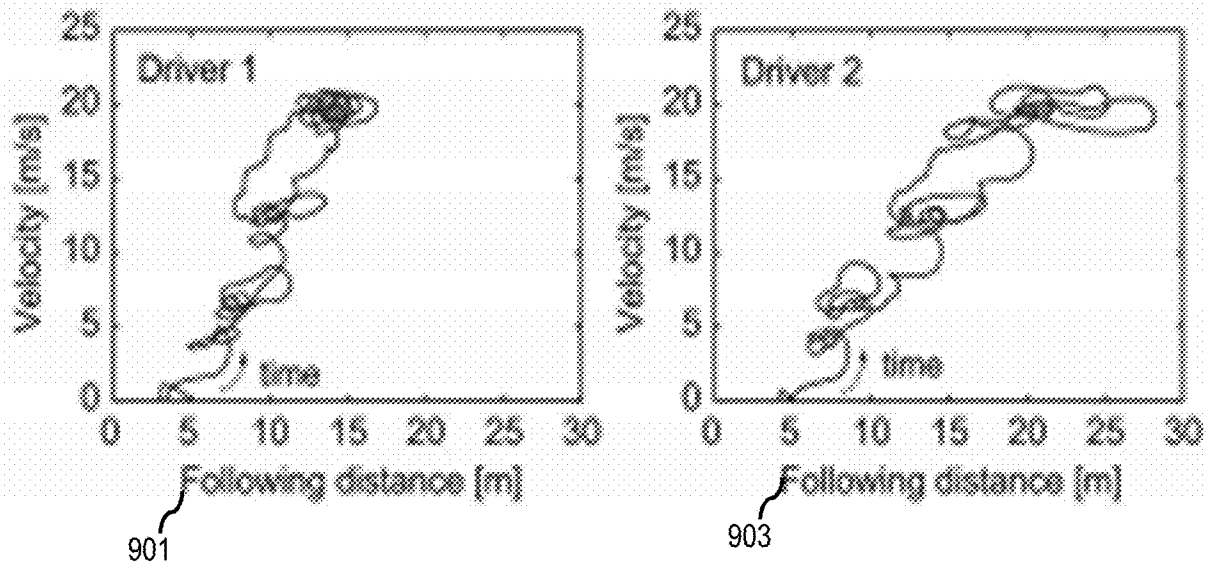
FIG. 9 is a graph diagram that represents status for one or more vehicles, according to one example embodiment.

FIG. 9 is a graph diagram that represents status for one or more vehicles, according to one example embodiment. In one scenario, the classification platform 109 may extract vehicle status information from one or more sensors at time t. The classification platform 109 may determine that a manually driven vehicle may have certain speed pattern that is different from a fully automated vehicle. In one example embodiment, graph 901 may represent a manually driven vehicle because it represents a slower and erratic speed pattern, whilst graph 903 may represent a fully automated vehicle because it represents a faster and smooth speed pattern. In another scenario, the one or more sensors on the candidate's vehicle may capture distance between the candidate's vehicle and the vehicle that it is trailing. The classification platform 109 may determine a candidate vehicle to be a fully automated vehicle based, at least in part, on the distance maintained with other nearby vehicles.

Figure 10:
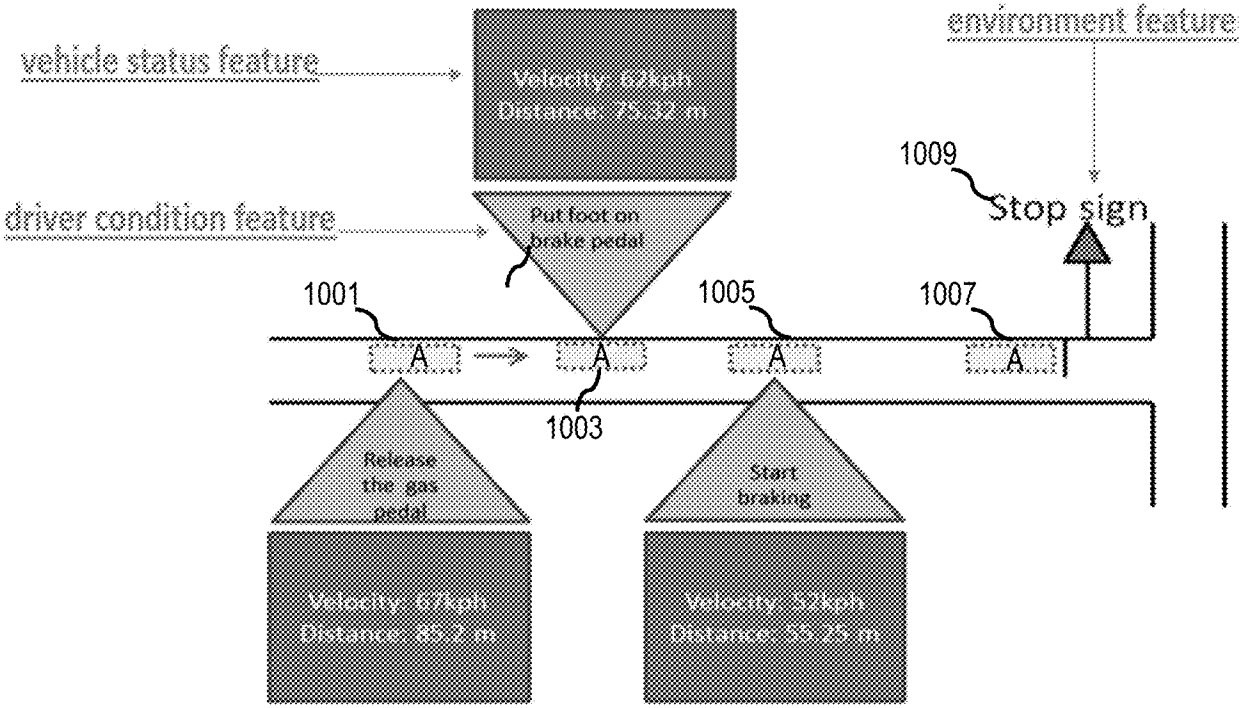
FIG. 10 is a diagram that combines vehicle status, driver condition and environmental condition for classifying at least one vehicle, according to one example embodiment.

FIG. 10 is a diagram that combines vehicle status, driver condition and environmental condition for classifying at least one vehicle, according to one example embodiment. In one scenario, the classification platform 109 may combine telematics sensor data (e.g., driver behavior, vehicle status) with the real world referenced map data (e.g., location of stop sign, location of stop light, sharp turn, hills). In one example embodiment, vehicle A may be travelling at the velocity rate of 67 kilometer per hour (kph) in stage 1001 as detected via accelerometer. Given that vehicle A is approaching a stop sign 1009, the motion sensor and/or the camera sensor may detect emotions of a driver (e.g., driver is alert) and/or eye movements of the driver during driving profile construction. Further, brake pressure sensors may detect in stage 1003 that the driver firmly adjusts his foot on the brake pedal and releases the gas pedal. This reduces the velocity for vehicle A to 62 kph. In addition, as vehicle A approaches closer to the stop sign 1009 the brake pressure sensors may detect (stage 1005) that the driver starts to decelerate by pressing the brakes. This slows down the vehicle to 52 kph. Ultimately, vehicle A comes to a stop at stage 1007. The classification platform 109 may determine vehicle A to be a manually driven vehicle based on a feature derived from vehicle status, driver condition, and environment.

FIG. 11A is a diagram that represents a training model to classify one or more vehicles, according to one example embodiment. In one embodiment, the classification platform 109 may collect historical data (i.e., ground truth data) from one or more vehicles. The historical data may be processed to determine the label (i.e., manually driven vehicle, partially autonomous vehicle, or a fully autonomous vehicle) for the one or more vehicles. This is the training data for the machine learning model. Then, the classification platform 109 may extract relevant features from new vehicles that correspond to the labels. In one example embodiment, relevant features for a manually driven vehicle may be extracted using the ground truth data that has been collected historically as the first entry 1101. Similarly, the vehicle status feature 1103, the driver condition feature 1105, environmental feature 1107, the derived feature 1109, or a combination thereof may be extracted for numerous manually driven vehicles, partially autonomous vehicles, fully autonomous vehicles, or a combination thereof. In one embodiment, this training data may be passed to any machine learning model, for example, decision tree, rule based machine learning model.

FIG. 11B is a diagram wherein features for at least one new vehicle (i.e., vehicle not already used for the training data) are extracted for determine their level of automation, according to one example embodiment. In one scenario, the one or more extracted features may include but is not limited to vehicle status, driver status, environmental features, derived features, or a combination thereof. Then, the extracted features may be passed to the trained machine learning model (i.e., FIG. 11A). Then, the machine learning model may use the features to determine the level of automation, and automatically determines the vehicle class. That is, the machine learning model automatically classifies the vehicle as a manually driven, a partially autonomous, or a fully autonomous vehicle based on the incoming data about the vehicle status, driver condition, environment, and a combination thereof. In one scenario, the machine learning model makes an automated decision on the vehicle category based on its learning during the training process. The machine learning model may determine the vehicle to be a manually driven vehicle in this case.

Figure 12:
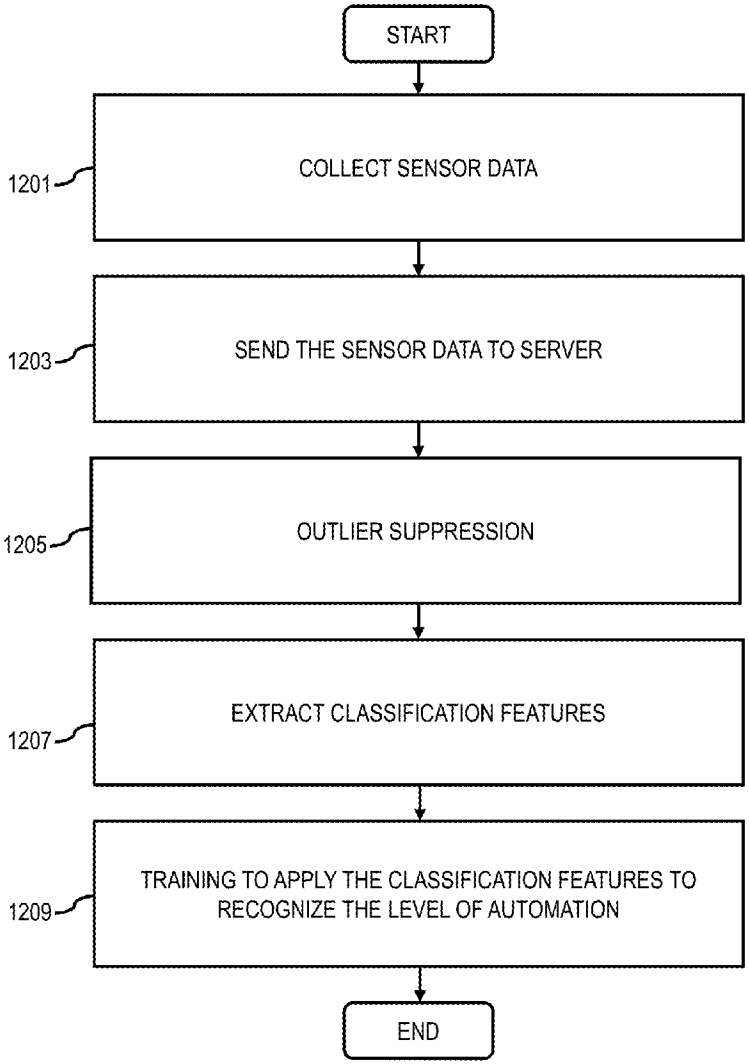
FIG. 12 is a flow diagram that represents a training phase where many training examples (features and levels of automation) are used to train a machine learning model (e.g., Bayes, Decision Trees, Random Forest, etc.), according to one example embodiment.

FIG. 12 is a flow diagram that represents the training phase where many training examples (features and levels of automation) are used to train a machine learning model (e.g., Bayes, Decision Trees, Random Forest, etc.), according to one example embodiment. In step 1201, the sensor data collector 201 may collect sensor data from one or more devices associated with one or more vehicles, one or more users, or a combination thereof. In step 1203, the communication module 203 may send the sensor data to outlier suppression module 205 for processing of the sensor data to determine accuracy information, reliability information, relevancy information, or a combination thereof (step 1205). Then, in step 1207, the outlier suppression module 205 may extract classification features (e.g., a vehicle status feature, a driver condition feature, an environmental feature, or a combination thereof). In step 1209, the training and learning module 209 causes pattern recognition of the classification features to determine a level of automation for the one or more new vehicles.

Figure 13:
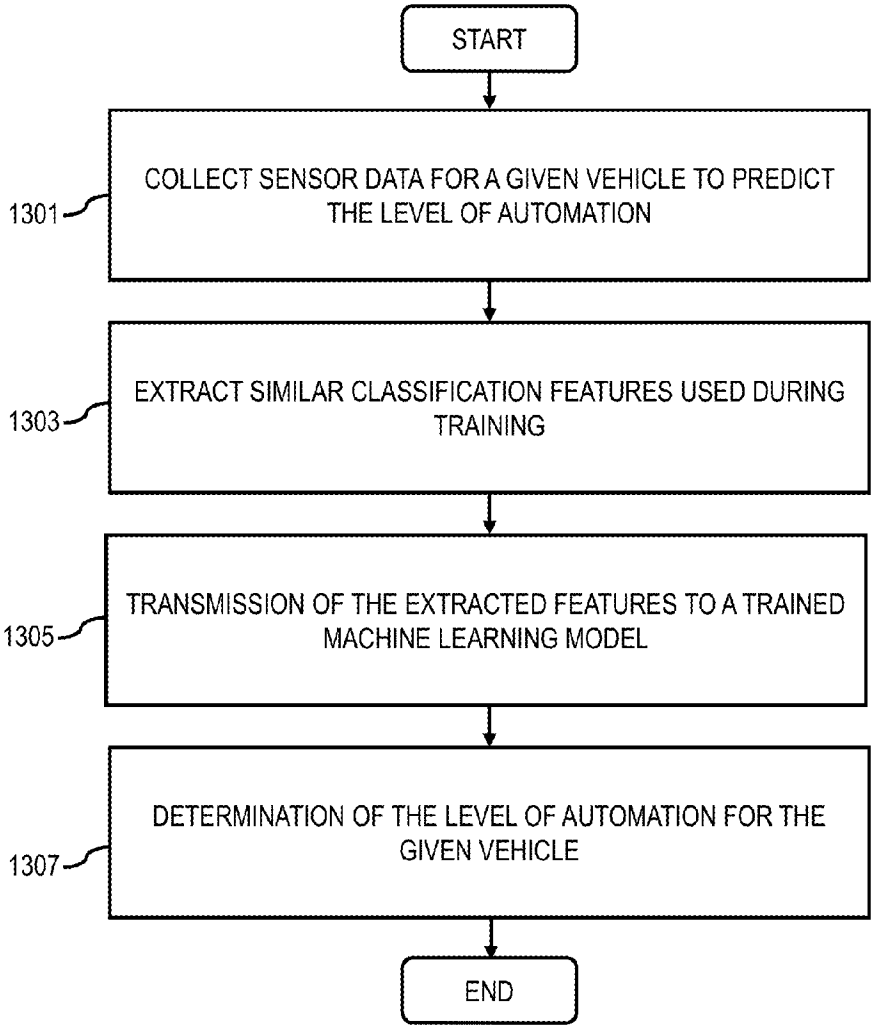
FIG. 13 is a flow diagram that represents a prediction phase for at least one vehicle, according to one example embodiment.

FIG. 13 is a flow diagram that represents a prediction phase for at least one vehicle, according to one example embodiment. In one scenario, the sensor data collector 201 may collect sensor data for at least one new vehicle to predict its level of automation (step 1301). In step 1303, the outlier suppression module 205 may extract similar set of features from the at least one new vehicle. In step 1305, the communication module 203 may pass the extracted set of similar features to the trained machine learning model for automatically determining the level of automation (i.e. manual, partially autonomous, and fully autonomous).

The processes described herein for classifying one or more vehicles based on their level of automation may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

Figure 14:
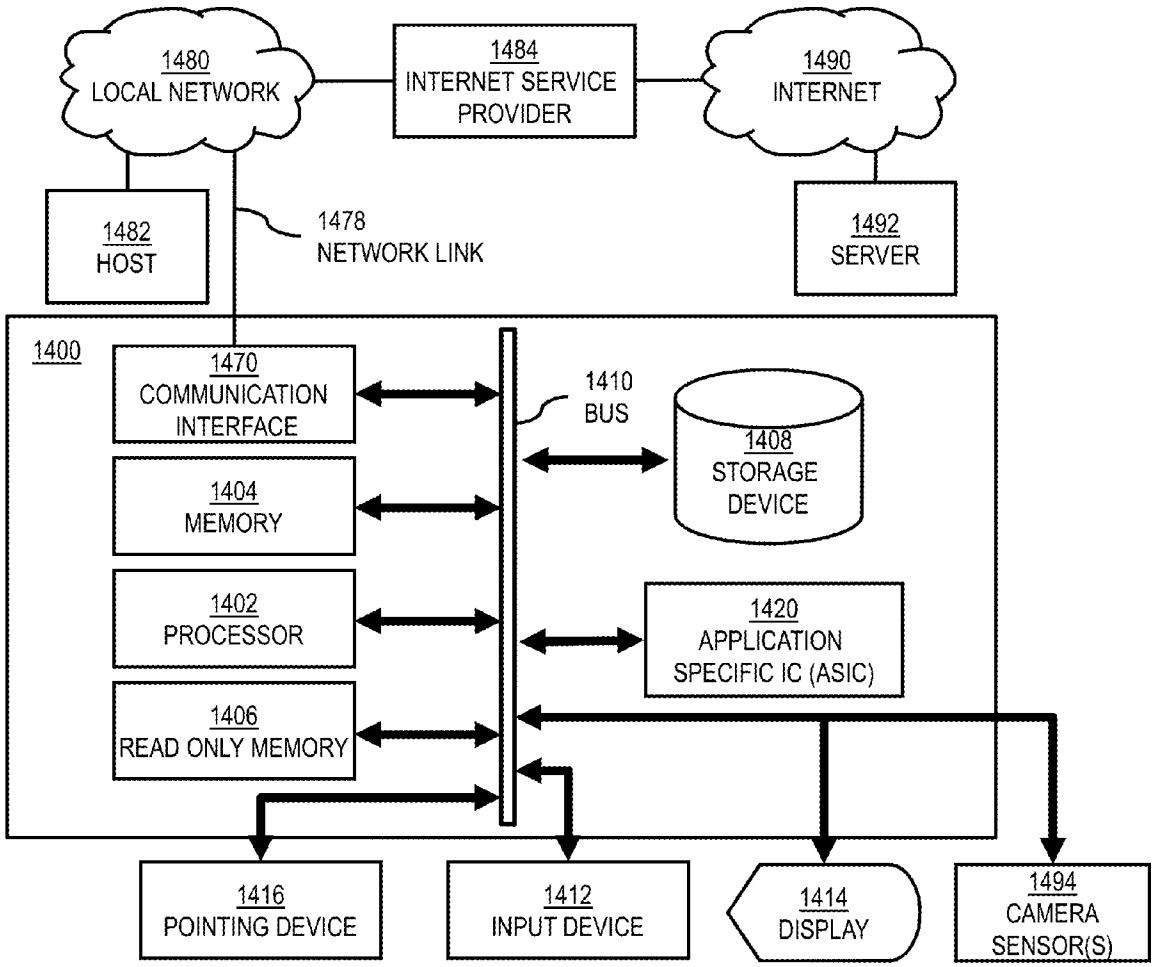
FIG. 14 is a diagram of hardware that can be used to implement an embodiment of the invention.

FIG. 14 illustrates a computer system 1400 upon which an embodiment of the invention may be implemented. Although computer system 1400 is depicted with respect to a particular device or equipment, it is contemplated that other devices or equipment (e.g., network elements, servers, etc.) within FIG. 14 can deploy the illustrated hardware and components of system 1400. Computer system 1400 is programmed (e.g., via computer program code or instructions) to classify one or more vehicles based on their level of automation as described herein and includes a communication mechanism such as a bus 1410 for passing information between other internal and external components of the computer system 1400. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range. Computer system 1400, or a portion thereof, constitutes a means for performing one or more steps of classifying one or more vehicles based on their level of automation.

A bus 1410 includes one or more parallel conductors of information so that information is transferred quickly among devices coupled to the bus 1410. One or more processors 1402 for processing information are coupled with the bus 1410.

A processor (or multiple processors) 1402 performs a set of operations on information as specified by computer program code related to classify one or more vehicles based on their level of automation. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 1410 and placing information on the bus 1410. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 1402, such as a sequence of operation codes, constitute processor instructions, also called computer system instructions or, simply, computer instructions. Processors may be implemented as mechanical, electrical, magnetic, optical, chemical, or quantum components, among others, alone or in combination.

Computer system 1400 also includes a memory 1404 coupled to bus 1410. The memory 1404, such as a random access memory (RAM) or any other dynamic storage device, stores information including processor instructions for classifying one or more vehicles based on their level of automation. Dynamic memory allows information stored therein to be changed by the computer system 1400. RAM allows a unit of information stored at a location called a memory address to be stored and retrieved independently of information at neighboring addresses. The memory 1404 is also used by the processor 1402 to store temporary values during execution of processor instructions. The computer system 1400 also includes a read only memory (ROM) 1406 or any other static storage device coupled to the bus 1410 for storing static information, including instructions, that is not changed by the computer system 1400. Some memory is composed of volatile storage that loses the information stored thereon when power is lost. Also coupled to bus 1410 is a non-volatile (persistent) storage device 1408, such as a magnetic disk, optical disk or flash card, for storing information, including instructions, that persists even when the computer system 1400 is turned off or otherwise loses power.

Information, including instructions for classifying one or more vehicles based on their level of automation, is provided to the bus 1410 for use by the processor from an external input device 1412, such as a keyboard containing alphanumeric keys operated by a human user, a microphone, an Infrared (IR) remote control, a joystick, a game pad, a stylus pen, a touch screen, or a sensor. A sensor detects conditions in its vicinity and transforms those detections into physical expression compatible with the measurable phenomenon used to represent information in computer system 1400. Other external devices coupled to bus 1410, used primarily for interacting with humans, include a display device 1414, such as a cathode ray tube (CRT), a liquid crystal display (LCD), a light emitting diode (LED) display, an organic LED (OLED) display, a plasma screen, or a printer for presenting text or images, and a pointing device 1416, such as a mouse, a trackball, cursor direction keys, or a motion sensor, for controlling a position of a small cursor image presented on the display 1414 and issuing commands associated with graphical elements presented on the display 1414, and one or more camera sensors 1494 for capturing, recording and causing to store one or more still and/or moving images (e.g., videos, movies, etc.) which also may comprise audio recordings. In some embodiments, for example, in embodiments in which the computer system 1400 performs all functions automatically without human input, one or more of external input device 1412, display device 1414 and pointing device 1416 may be omitted.

In the illustrated embodiment, special purpose hardware, such as an application specific integrated circuit (ASIC) 1420, is coupled to bus 1410. The special purpose hardware is configured to perform operations not performed by processor 1402 quickly enough for special purposes. Examples of ASICs include graphics accelerator cards for generating images for display 1414, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 1400 also includes one or more instances of a communications interface 1470 coupled to bus 1410. Communication interface 1470 provides a one-way or two-way communication coupling to a variety of external devices that operate with their own processors, such as printers, scanners and external disks. In general the coupling is with a network link 1478 that is connected to a local network 1480 to which a variety of external devices with their own processors are connected. For example, communication interface 1470 may be a parallel port or a serial port or a universal serial bus (USB) port on a personal computer. In some embodiments, communications interface 1470 is an integrated services digital network (ISDN) card or a digital subscriber line (DSL) card or a telephone modem that provides an information communication connection to a corresponding type of telephone line. In some embodiments, a communication interface 1470 is a cable modem that converts signals on bus 1410 into signals for a communication connection over a coaxial cable or into optical signals for a communication connection over a fiber optic cable. As another example, communications interface 1470 may be a local area network (LAN) card to provide a data communication connection to a compatible LAN, such as Ethernet. Wireless links may also be implemented. For wireless links, the communications interface 1470 sends or receives or both sends and receives electrical, acoustic or electromagnetic signals, including infrared and optical signals, that carry information streams, such as digital data. For example, in wireless handheld devices, such as mobile telephones like cell phones, the communications interface 1470 includes a radio band electromagnetic transmitter and receiver called a radio transceiver. In certain embodiments, the communications interface 1470 enables connection to the communication network 107 for classifying one or more vehicles based on their level of automation to the UE 101.

The term "computer-readable medium" as used herein refers to any medium that participates in providing information to processor 1402, including instructions for execution. Such a medium may take many forms, including, but not limited to computer-readable storage medium (e.g., non-volatile media, volatile media), and transmission media. Non-transitory media, such as non-volatile media, include, for example, optical or magnetic disks, such as storage device 1408. Volatile media include, for example, dynamic memory 1404. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

Logic encoded in one or more tangible media includes one or both of processor instructions on a computer-readable storage media and special purpose hardware, such as ASIC 1420.

Network link 1478 typically provides information communication using transmission media through one or more networks to other devices that use or process the information. For example, network link 1478 may provide a connection through local network 1480 to a host computer 1482 or to equipment 1484 operated by an Internet Service Provider (ISP). ISP equipment 1484 in turn provides data communication services through the public, world-wide packet-switching communication network of networks now commonly referred to as the Internet 1490.

A computer called a server host 1492 connected to the Internet hosts a process that provides a service in response to information received over the Internet. For example, server host 1492 hosts a process that provides information representing video data for presentation at display 1414. It is contemplated that the components of system 1400 can be deployed in various configurations within other computer systems, e.g., host 1482 and server 1492.

At least some embodiments of the invention are related to the use of computer system 1400 for implementing some or all of the techniques described herein. According to one embodiment of the invention, those techniques are performed by computer system 1400 in response to processor 1402 executing one or more sequences of one or more processor instructions contained in memory 1404. Such instructions, also called computer instructions, software and program code, may be read into memory 1404 from another computer-readable medium such as storage device 1408 or network link 1478. Execution of the sequences of instructions contained in memory 1404 causes processor 1402 to perform one or more of the method steps described herein. In alternative embodiments, hardware, such as ASIC 1420, may be used in place of or in combination with software to implement the invention. Thus, embodiments of the invention are not limited to any specific combination of hardware and software, unless otherwise explicitly stated herein.

The signals transmitted over network link 1478 and other networks through communications interface 1470, carry information to and from computer system 1400. Computer system 1400 can send and receive information, including program code, through the networks 1480, 1490 among others, through network link 1478 and communications interface 1470. In an example using the Internet 1490, a server host 1492 transmits program code for a particular application, requested by a message sent from computer 1400, through Internet 1490, ISP equipment 1484, local network 1480 and communications interface 1470. The received code may be executed by processor 1402 as it is received, or may be stored in memory 1404 or in storage device 1408 or any other non-volatile storage for later execution, or both. In this manner, computer system 1400 may obtain application program code in the form of signals on a carrier wave.

Various forms of computer readable media may be involved in carrying one or more sequence of instructions or data or both to processor 1402 for execution. For example, instructions and data may initially be carried on a magnetic disk of a remote computer such as host 1482. The remote computer loads the instructions and data into its dynamic memory and sends the instructions and data over a telephone line using a modem. A modem local to the computer system 1400 receives the instructions and data on a telephone line and uses an infra-red transmitter to convert the instructions and data to a signal on an infra-red carrier wave serving as the network link 1478. An infrared detector serving as communications interface 1470 receives the instructions and data carried in the infrared signal and places information representing the instructions and data onto bus 1410. Bus 1410 carries the information to memory 1404 from which processor 1402 retrieves and executes the instructions using some of the data sent with the instructions. The instructions and data received in memory 1404 may optionally be stored on storage device 1408, either before or after execution by the processor 1402.

FIG. 15 illustrates a chip set or chip 1500 upon which an embodiment of the invention may be implemented. Chip set 1500 is programmed to classify one or more vehicles based on their level of automation as described herein and includes, for instance, the processor and memory components described with respect to FIG. 14 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 1500 can be implemented in a single chip. It is further contemplated that in certain embodiments the chip set or chip 1500 can be implemented as a single "system on a chip." It is further contemplated that in certain embodiments a separate ASIC would not be used, for example, and that all relevant functions as disclosed herein would be performed by a processor or processors. Chip set or chip 1500, or a portion thereof, constitutes a means for performing one or more steps of providing user interface navigation information associated with the availability of functions. Chip set or chip 1500, or a portion thereof, constitutes a means for performing one or more steps of classifying one or more vehicles based on their level of automation.

In one embodiment, the chip set or chip 1500 includes a communication mechanism such as a bus 1501 for passing information among the components of the chip set 1500. A processor 1503 has connectivity to the bus 1501 to execute instructions and process information stored in, for example, a memory 1505. The processor 1503 may include one or more processing cores with each core configured to perform independently. A multi-core processor enables multiprocessing within a single physical package. Examples of a multi-core processor include two, four, eight, or greater numbers of processing cores. Alternatively or in addition, the processor 1503 may include one or more microprocessors configured in tandem via the bus 1501 to enable independent execution of instructions, pipelining, and multithreading. The processor 1503 may also be accompanied with one or more specialized components to perform certain processing functions and tasks such as one or more digital signal processors (DSP) 1507, or one or more application-specific integrated circuits (ASIC) 1509. A DSP 1507 typically is configured to process real-world signals (e.g., sound) in real time independently of the processor 1503. Similarly, an ASIC 1509 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one embodiment, the chip set or chip 1500 includes merely one or more processors and some software and/or firmware supporting and/or relating to and/or for the one or more processors.

The processor 1503 and accompanying components have connectivity to the memory 1505 via the bus 1501. The memory 1505 includes both dynamic memory (e.g., RAM, magnetic disk, writable optical disk, etc.) and static memory (e.g., ROM, CD-ROM, etc.) for storing executable instructions that when executed perform the inventive steps described herein to classify one or more vehicles based on their level of automation. The memory 1505 also stores the data associated with or generated by the execution of the inventive steps.

Figure 16:
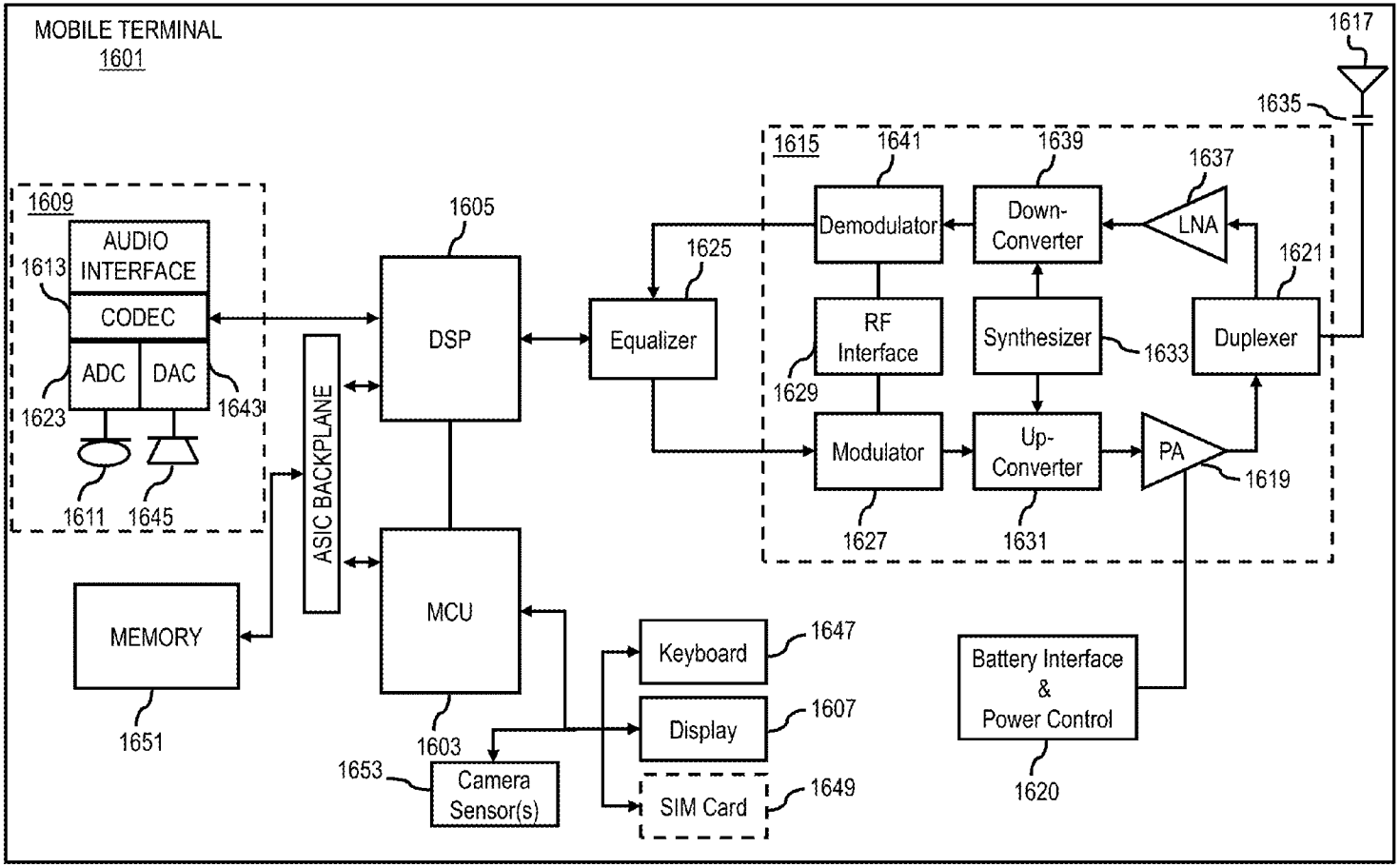
FIG. 16 is a diagram of a mobile terminal (e.g., handset) that can be used to implement an embodiment of the invention.

FIG. 16 is a diagram of exemplary components of a mobile terminal (e.g., handset) for communications, which is capable of operating in the system of FIG. 1, according to one embodiment. In some embodiments, mobile terminal 1601, or a portion thereof, constitutes a means for performing one or more steps of classifying one or more vehicles based on their level of automation. Generally, a radio receiver is often defined in terms of front-end and back-end characteristics. The front-end of the receiver encompasses all of the Radio Frequency (RF) circuitry whereas the back-end encompasses all of the base-band processing circuitry. As used in this application, the term "circuitry" refers to both: (1) hardware-only implementations (such as implementations in only analog and/or digital circuitry), and (2) to combinations of circuitry and software (and/or firmware) (such as, if applicable to the particular context, to a combination of processor(s), including digital signal processor(s), software, and memory(ies) that work together to cause an apparatus, such as a mobile phone or server, to perform various functions). This definition of "circuitry" applies to all uses of this term in this application, including in any claims. As a further example, as used in this application and if applicable to the particular context, the term "circuitry" would also cover an implementation of merely a processor (or multiple processors) and its (or their) accompanying software/or firmware. The term "circuitry" would also cover if applicable to the particular context, for example, a base-band integrated circuit or applications processor integrated circuit in a mobile phone or a similar integrated circuit in a cellular network device or other network devices.

Pertinent internal components of the telephone include a Main Control Unit (MCU) 1603, a Digital Signal Processor (DSP) 1605, and a receiver/transmitter unit including a microphone gain control unit and a speaker gain control unit. A main display unit 1607 provides a display to the user in support of various applications and mobile terminal functions that perform or support the steps of classifying one or more vehicles based on their level of automation. The display 1607 includes display circuitry configured to display at least a portion of a user interface of the mobile terminal (e.g., mobile telephone). Additionally, the display 1607 and display circuitry are configured to facilitate user control of at least some functions of the mobile terminal. An audio function circuitry 1609 includes a microphone 1611 and microphone amplifier that amplifies the speech signal output from the microphone 1611. The amplified speech signal output from the microphone 1611 is fed to a coder/decoder (CODEC) 1613.

A radio section 1615 amplifies power and converts frequency in order to communicate with a base station, which is included in a mobile communication system, via antenna 1617. The power amplifier (PA) 1619 and the transmitter/modulation circuitry are operationally responsive to the MCU 1603, with an output from the PA 1619 coupled to the duplexer 1621 or circulator or antenna switch, as known in the art. The PA 1619 also couples to a battery interface and power control unit 1620.

In use, a user of mobile terminal 1601 speaks into the microphone 1611 and his or her voice along with any detected background noise is converted into an analog voltage. The analog voltage is then converted into a digital signal through the Analog to Digital Converter (ADC) 1623. The control unit 1603 routes the digital signal into the DSP 1605 for processing therein, such as speech encoding, channel encoding, encrypting, and interleaving. In one embodiment, the processed voice signals are encoded, by units not separately shown, using a cellular transmission protocol such as enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wideband code division multiple access (WCDMA), wireless fidelity (WiFi), satellite, and the like, or any combination thereof.

The encoded signals are then routed to an equalizer 1625 for compensation of any frequency-dependent impairments that occur during transmission though the air such as phase and amplitude distortion. After equalizing the bit stream, the modulator 1627 combines the signal with a RF signal generated in the RF interface 1629. The modulator 1627 generates a sine wave by way of frequency or phase modulation. In order to prepare the signal for transmission, an up-converter 1631 combines the sine wave output from the modulator 1627 with another sine wave generated by a synthesizer 1633 to achieve the desired frequency of transmission. The signal is then sent through a PA 1619 to increase the signal to an appropriate power level. In practical systems, the PA 1619 acts as a variable gain amplifier whose gain is controlled by the DSP 1605 from information received from a network base station. The signal is then filtered within the duplexer 1621 and optionally sent to an antenna coupler 1635 to match impedances to provide maximum power transfer. Finally, the signal is transmitted via antenna 1617 to a local base station. An automatic gain control (AGC) can be supplied to control the gain of the final stages of the receiver. The signals may be forwarded from there to a remote telephone which may be another cellular telephone, any other mobile phone or a land-line connected to a Public Switched Telephone Network (PSTN), or other telephony networks.

Voice signals transmitted to the mobile terminal 1601 are received via antenna 1617 and immediately amplified by a low noise amplifier (LNA) 1637. A down-converter 1639 lowers the carrier frequency while the demodulator 1641 strips away the RF leaving only a digital bit stream. The signal then goes through the equalizer 1625 and is processed by the DSP 1605. A Digital to Analog Converter (DAC) 1643 converts the signal and the resulting output is transmitted to the user through the speaker 1645, all under control of a Main Control Unit (MCU) 1603 which can be implemented as a Central Processing Unit (CPU).

The MCU 1603 receives various signals including input signals from the keyboard 1647. The keyboard 1647 and/or the MCU 1603 in combination with other user input components (e.g., the microphone 1611) comprise a user interface circuitry for managing user input. The MCU 1603 runs a user interface software to facilitate user control of at least some functions of the mobile terminal 1601 to classify one or more vehicles based on their level of automation. The MCU 1603 also delivers a display command and a switch command to the display 1607 and to the speech output switching controller, respectively. Further, the MCU 1603 exchanges information with the DSP 1605 and can access an optionally incorporated SIM card 1649 and a memory 1651. In addition, the MCU 1603 executes various control functions required of the terminal. The DSP 1605 may, depending upon the implementation, perform any of a variety of conventional digital processing functions on the voice signals. Additionally, DSP 1605 determines the background noise level of the local environment from the signals detected by microphone 1611 and sets the gain of microphone 1611 to a level selected to compensate for the natural tendency of the user of the mobile terminal 1601.

The CODEC 1613 includes the ADC 1623 and DAC 1643. The memory 1651 stores various data including call incoming tone data and is capable of storing other data including music data received via, e.g., the global Internet. The software module could reside in RAM memory, flash memory, registers, or any other form of writable storage medium known in the art. The memory device 1651 may be, but not limited to, a single memory, CD, DVD, ROM, RAM, EEPROM, optical storage, magnetic disk storage, flash memory storage, or any other non-volatile storage medium capable of storing digital data.

An optionally incorporated SIM card 1649 carries, for instance, important information, such as the cellular phone number, the carrier supplying service, subscription details, and security information. The SIM card 1649 serves primarily to identify the mobile terminal 1601 on a radio network. The card 1649 also contains a memory for storing a personal telephone number registry, text messages, and user specific mobile terminal settings.

Further, one or more camera sensors 1653 may be incorporated onto the mobile station 1601 wherein the one or more camera sensors may be placed at one or more locations on the mobile station. Generally, the camera sensors may be utilized to capture, record, and cause to store one or more still and/or moving images (e.g., videos, movies, etc.) which also may comprise audio recordings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A method comprising:

determining, by an apparatus, training sensor data collected during at least one driving operation of one or more vehicles, wherein one or more driving automation levels of the one or more vehicles are known;

determining, by the apparatus, one or more sensor signatures for the one or more driving automation levels based, at least in part, on one or more values of one or more classification features extracted from the training sensor data, wherein the one or more classification features include one or more manually driving pattern features and one or more automatically driving pattern features, and the one or more manually driving pattern features include one or more driver physical movement features of manually driving;

determining, by the apparatus, a classification of one or more other vehicles into the one or more driving automation levels based, at least in part, on a comparison of the one or more sensor signatures with sensor data collected during at least one driving operation of the one or more other vehicles and a comparison of the sensor data collected during at least one driving operation of the one or more other vehicles to the one or more manually driving pattern features and the one or more automatically driving pattern features; and adjusting, by the apparatus, power and bandwidth consumption by sampling additional sensor data from the one or more other vehicles at different frequencies based on the classification.

2. A method of claim 1, further comprising:

determining the one or more sensor signatures, the one or more values of the one or more classification features, or a combination thereof as at least one time series; and initiating a presentation on a user interface of the one or more other vehicles based on the classification.

3. A method of claim 1, further comprising:

determining whether the one or more other vehicles are abiding by traffic regulations by applying different traffic rules on the one or more other vehicles based on the classification, wherein the one or more driving automation levels include, at least in part, a manually driving vehicle, a partially autonomous vehicle, a fully autonomous vehicle, or a combination thereof.

4. A method of claim 3, wherein the one or more classification features include, at least in part, one or more vehicle status features, one or more environmental features, or a combination thereof, and wherein the presentation includes one or more visual advertisements when the one or more other vehicles are classified as a fully autonomous vehicle.

5. A method of claim 4, wherein the one or more vehicle status features include, at least in part, a relative position of at least one vehicle within at least one lane, a distance between at least one leading vehicle and at least one trailing vehicle relative to at least one target vehicle, an acceleration information for at least one vehicle, or a combination thereof.

6. A method of claim 1, further comprising:

determining the one or more driver physical movement features based, at least in part, on a limb granularity, wherein the limb granularity categorizes the one or more driver physical movement features based, at least in part, one or more features associated with a vehicle operation by foot, a vehicle operation by hand, or a combination thereof.

7. A method of claim 6, wherein the one or more features associated with the vehicle operation by foot includes, at least in part, a sensed position and frequency of function of a foot on a brake pedal, a sensed position and frequency of function of a foot on a gas pedal, or a combination thereof; and wherein the one or more features associated with the vehicle operation by hand includes, at least in part, a steering wheel angle, a wiper operation, a blinker operation, a gear shift operation, or a combination thereof.

8. A method of claim 4, wherein the one or more environmental features include, at least in part, road network information, traffic information, vehicle internal temperature information, external temperature information, weather information, or a combination thereof.

9. A method of claim 4, further comprising:

determining at least one derived feature by combining the one or more vehicle status features, the one or more driver physical movement features, the one or more environmental features, or a combination thereof as a single feature, wherein the one or more classification features include, at least in part, the at least one derived feature.

10. A method of claim 1, further comprising:

initiating a filtering of the training sensor data, the sensor data associated with the one or more other vehicles based, at least in part, on an outlier suppression.

11. An apparatus comprising:

at least one processor; and at least one memory including computer program code for one or more programs, the at least one memory and the computer program code configured to, with the at least one processor, cause the apparatus to perform at least the following;

determine training sensor data collected during at least one driving operation of one or more vehicles, wherein one or more driving automation levels of the one or more vehicles are known;

determine one or more sensor signatures for the one or more driving automation levels based, at least in part, on one or more values of one or more classification features extracted from the training sensor data, wherein the one or more classification features include one or more manually driving pattern features and one or more automatically driving pattern features, and the one or more manually driving pattern features include one or more driver physical movement features of manually driving;

determine a classification of one or more other vehicles into the one or more driving automation levels based, at least in part, on a comparison of the one or more sensor signatures with sensor data collected during at least one driving operation of the one or more other vehicles and a comparison of the sensor data collected during at least one driving operation of the one or more other vehicles to the one or more manually driving pattern features and the one or more automatically driving pattern features; and adjust power and bandwidth consumption by sampling additional sensor data from the one or more other vehicles at different frequencies based on the classification.

12. An apparatus of claim 11, wherein the apparatus is further caused to:

determine the one or more sensor signatures, the one or more values of the one or more classification features, or a combination thereof as at least one time series; and initiate a presentation on a user interface of the one or more other vehicles based on the classification.

13. An apparatus of claim 11, wherein the apparatus is further caused to:

determine whether the one or more other vehicles are abiding by traffic regulations by applying different traffic rules on the one or more other vehicles based on the classification, wherein the one or more automation levels include, at least in part, a manually driving vehicle, a partially autonomous vehicle, a fully autonomous vehicle, or a combination thereof.

14. An apparatus of claim 11, wherein the one or more classification features include, at least in part, one or more vehicle status features, one or more driver physical movement features, one or more environmental features, or a combination thereof.

15. An apparatus of claim 14, wherein the one or more vehicle status features include, at least in part, a relative position of at least one vehicle within at least one lane, a distance between at least one leading vehicle and at least one trailing vehicle relative to at least one target vehicle, an acceleration information for at least one vehicle, or a combination thereof.

16. A non-transitory computer-readable storage medium carrying one or more sequences of one or more instructions which, when executed by one or more processors, cause an apparatus to perform:

determining training sensor data collected during at least one driving operation of one or more vehicles, wherein one or more driving automation levels of the one or more vehicles are known;

determining one or more sensor signatures for the one or more driving automation levels based, at least in part, on one or more values of one or more classification features extracted from the training sensor data, wherein the one or more classification features include one or more manually driving pattern features and one or more automatically driving pattern features, and the one or more manually driving pattern features include one or more driver physical movement features of manually driving;

determining a classification of one or more other vehicles into the one or more driving automation levels based, at least in part, on a comparison of the one or more sensor signatures with sensor data collected during at least one driving operation of the one or more other vehicles and a comparison of the sensor data collected during at least one driving operation of the one or more other vehicles to the one or more manually driving pattern features and the one or more automatically driving pattern features; and adjusting power and bandwidth consumption by sampling additional sensor data from the one or more other vehicles at different frequencies based on the classification.

17. A non-transitory computer-readable storage medium of claim 16, wherein the apparatus is further caused to perform:

determining the one or more signatures, the one or more values of the one or more classification features, or a combination thereof as at least one time series; and initiating a presentation on a user interface of the one or more other vehicles based on the classification.

18. A non-transitory computer-readable storage medium of claim 16, wherein the apparatus is further caused to perform:

determining whether the one or more other vehicles are abiding by traffic regulations by applying different traffic rules on the one or more other vehicles based on the classification, wherein the one or more automation levels include, at least in part, a manually driving vehicle, a partially autonomous vehicle, a fully autonomous vehicle, or a combination thereof.

19. A method of claim 1, wherein the one or more manually driving pattern features and the one or more automatically driving pattern features include one or more relative speeds of the one or more other vehicles from one or more neighboring vehicles, one or more relative distances of the one or more other vehicles from one or more lanes, one or more roadways, the one or more neighboring vehicles, one or more neighboring pedestrians, one or more neighboring traffic lights, one or more neighboring potholes, or a combination thereof.

20. A method of claim 3, further comprising:

initiating, by the apparatus, a transmission of the classification of the one or more other vehicles to a traffic law enforcement entity.

* * * * *